US009328973B2

(12) United States Patent
Jindou et al.

(10) Patent No.: US 9,328,973 B2
(45) Date of Patent: May 3, 2016

(54) HEAT EXCHANGER AND AIR CONDITIONER

(75) Inventors: Masanori Jindou, Osaka (JP); Yoshio Oritani, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 279 days.

(21) Appl. No.: 13/980,655

(22) PCT Filed: Jan. 23, 2012

(86) PCT No.: PCT/JP2012/000402
§ 371 (c)(1),
(2), (4) Date: Jul. 19, 2013

(87) PCT Pub. No.: WO2012/098920
PCT Pub. Date: Jul. 26, 2012

(65) Prior Publication Data

US 2013/0306286 A1 Nov. 21, 2013

(30) Foreign Application Priority Data

Jan. 21, 2011 (JP) ..... 2011-011269

(51) Int. Cl.

| | |
|---|---|
| ***F28F 1/32*** | (2006.01) |
| ***F28F 9/02*** | (2006.01) |
| ***F28D 1/053*** | (2006.01) |
| ***F28F 1/12*** | (2006.01) |
| ***F25B 39/00*** | (2006.01) |
| *F28D 21/00* | (2006.01) |

(52) U.S. Cl.
CPC . *F28F 9/02* (2013.01); *F25B 39/00* (2013.01); *F28D 1/05383* (2013.01); *F28F 1/12* (2013.01); *F28F 1/325* (2013.01); *F28D 2021/0068* (2013.01); *F28F 2215/04* (2013.01); *F28F 2215/12* (2013.01)

(58) Field of Classification Search
CPC ..... F28F 1/325; F28F 2215/12
USPC ..... 165/151, 182
See application file for complete search history.

(56) References Cited

U.S. PATENT DOCUMENTS 2,428,145 A 9/1947 Cook
3,167,046 A * 1/1965 Modine ..... 29/890.03
(Continued)

FOREIGN PATENT DOCUMENTS

CA 2368871 A1 * 8/2002
EP 0 769 669 A1 4/1997
(Continued)

*Primary Examiner* — Allen Flanigan
(74) *Attorney, Agent, or Firm* — Birch, Stewart, Kolasch & Birch, LLP

(57) ABSTRACT

A heat exchanger (30) includes vertically arranged flat tubes (33) and plate-like fins (36) arranged in the direction in which the flat tubes (33) extend. The flat tubes (33) are inserted into notches (45) of the fins (36). Parts of the fins (36) between vertically adjacent ones of the notches (45) are windward plate parts (70), and parts of the fins (36) at leeward sides of the notches (45) are leeward plate parts (75). Each of the windward plate parts (70) includes windward heat transfer promotion parts (71) constituted by protrusions (81-83) and louvers (50*a*, 50*b*). On the plate parts (75), leeward heat transfer promotion parts (76) constituted by leeward protrusions (84) are provided. The heat transfer promotion parts (76) are located at leeward sides of the notches (45), and overlap with the heat transfer promotion parts (71) when viewed from front edges (38) of the fins (36).

5 Claims, 10 Drawing Sheets

(56) References Cited

U.S. PATENT DOCUMENTS

| | | | | |
|---|---|---|---|---|
| 3,309,763 | A | 3/1967 | Oddy et al. | |
| 5,207,270 | A | 5/1993 | Yokoyama et al. | |
| 5,642,777 | A * | 7/1997 | Kang et al. | F28F 1/325 165/146 |
| 5,752,567 | A * | 5/1998 | Obosu | 165/151 |
| 6,964,296 | B2 * | 11/2005 | Memory et al. | 165/151 |
| 7,032,313 | B2 * | 4/2006 | Memory et al. | 29/890.047 |
| 7,111,670 | B2 * | 9/2006 | Yoshioka et al. | 165/152 |
| 2002/0134537 | A1 * | 9/2002 | Memory et al. | 165/151 |
| 2007/0163764 | A1 | 7/2007 | Kaga et al. | |
| 2007/0199686 | A1 | 8/2007 | Okinotani et al. | |
| 2008/0302131 | A1 | 12/2008 | Higashiyama | |

FOREIGN PATENT DOCUMENTS

| | | | |
|---|---|---|---|
| FR | 1480185 | A | 5/1967 |
| FR | 2832789 | A1 * | 5/2003 |
| FR | 2 872 891 | A1 | 1/2006 |
| GB | 2466687 | A * | 7/2010 |
| JP | 48-84947 | A | 11/1973 |
| JP | 60-174495 | A | 9/1985 |
| JP | 2-71096 | A | 3/1990 |
| JP | 3-31693 | A | 2/1991 |
| JP | 3-63499 | A | 3/1991 |
| JP | 03095394 | A * | 4/1991 |
| JP | 5-90173 | U | 12/1993 |
| JP | 06123587 | A * | 5/1994 |
| JP | 6-221787 | A | 8/1994 |
| JP | 6-300474 | A | 10/1994 |
| JP | 9-280754 | A | 10/1997 |
| JP | 10-339594 | A | 12/1998 |
| JP | 2000-234883 | A | 8/2000 |
| JP | 2003-262485 | A | 9/2003 |
| JP | 2006-170601 | A | 6/2006 |
| JP | 2007-232246 | A | 9/2007 |
| JP | 2008-215737 | A | 9/2008 |
| JP | 2008-241057 | A | 10/2008 |
| JP | 2009-281693 | A | 12/2009 |
| JP | 2009281693 | A * | 12/2009 |
| JP | 2010-54060 | A | 3/2010 |

* cited by examiner

HEAT EXCHANGER AND AIR CONDITIONER

TECHNICAL FIELD

The present disclosure relates to heat exchangers including flat tubes and fins and configured to perform heat exchange between air and fluid flowing in the flat tubes.

BACKGROUND ART

Heat exchangers including flat tubes and fins have been known in the art. Patent Documents 1 and 2 show heat exchangers of this type. Specifically, in each of the heat exchangers of Documents 1 and 2, laterally extending flat tubes are arranged to be spaced from one another in the vertical direction (i.e., the upward and downward directions) by a predetermined distance, and plate-like fins are arranged to be spaced from one another by a predetermined distance in the direction in which the flat tubes extend. For example, as illustrated in FIG. 2 of Patent Document 2, in the heat exchanger of this document, slender notches are formed in the fins, and the flat tubes are inserted in these notches. In this heat exchanger, air flowing between the fins exchanges heat with fluid flowing in the flat tubes.

In general, fins in heat exchangers of this type are provided with heat transfer promotion parts, e.g., bent-out parts, for promoting heat transfer of air between the fins. In the fins illustrated in FIGS. 3 and 13 of Patent Document 1 and FIG. 2 of Patent Document 2, a plurality of bent-out parts are arranged side by side in the air passage direction.

CITATION LIST

Patent Document

[Patent Document 1] Japanese Patent Publication No. 2003-262485

[Patent Document 2] Japanese Patent Publication No. 2010-054060

SUMMARY OF THE INVENTION

Technical Problem

Heat transfer promotion parts such as bent-out parts are generally formed by press work. Under constraints of work, flat portions are formed between the heat transfer promotion parts and notches into which flat tubes are inserted. That is, in the fins provided with the heat transfer promotion parts, portions extending along the flat tubes are flat.

As described above, in a heat exchanger, air flows between fins arranged in the direction in which flat tubes extend. Heat transfer promotion parts such as bent-out parts provided in the fins disturb the flow of air, thereby promoting heat transfer of air between the fins. In the fins provided with the heat transfer promotion parts, however, portions along the flat tubes are flat.

Air flowing between the fins is subjected to a higher resistance in portions where heat transfer promotion parts such as bent-out parts are formed than in flat portions. Accordingly, between the fins, the flow rate of air flowing along the flat portions near the flat tubes is relatively high, whereas the flow rate of air flowing along the portions where the heat transfer promotion parts are provided is relative low. Air flowing along the flat portions near the flat tubes passes through the heat exchanger while hardly exchanging heat with the fins.

Thus, even in the presence of the heat transfer promotion parts in the fins, disadvantageously, the heat transfer coefficient of the fins hardly increases.

It is therefore an object of the present disclosure to enhance performance of fins provided with heat transfer promotion parts in a heat exchanger including the fins and flat tubes.

Solution to the Problem

A first aspect of the present disclosure is directed to a heat exchanger including: flat tubes (33) vertically arranged with side surfaces thereof facing one another, each of the flat tubes (33) including a fluid passage (34) therein; and fins (36) having plate shapes, spaced from one another by a predetermined distance in a direction in which the flat tubes (33) extend, and each dividing a space between adjacent ones of the flat tubes (33) into a plurality of air passages (40) through which air flows. The fins (36) each have notches (45) into which the flat tubes (33) are inserted from front edges (38) of the fins (36) and which are spaced from one another by a predetermined distance in a longitudinal direction of the fins (36), parts of the fins (36) between vertically adjacent ones of the notches (45) are windward plate parts (70), parts of the fins (36) at leeward sides of the notches (45) are leeward plate parts (75), heat transfer promotion parts (71, 76) each including at least one of a bent-out part extending in a direction intersecting with an air passage direction or a protrusion extending in the direction intersecting with the air passage direction are provided on the windward plate parts (70) and the leeward plate parts (75), parts of the windward plate parts (70) of the fins (36) extending along the notches (45) located above and below the heat transfer promotion parts (71) are flat, and serve as flat parts (72, 73), and on the leeward plate parts (75) of the fins (36), each of the heat transfer promotion parts (76) each of which is located at a leeward side of an associated one of the notches (45) overlaps with the flat part (72, 73) extending along the associated one of the notches (45), when viewed from the front edges (38) of the fins (36).

In the first aspect, the heat exchanger (30) includes the flat tubes (33) and the fins (36). In the heat exchanger (30), the fins (36) are spaced from one another by a predetermined distance in a direction in which the flat tubes (33) extend, and the flat tubes (33) are inserted into the notches (45) formed in the fins (36). In the fins (36) of the heat exchanger (30), heat transfer promotion parts (71, 76) are provided on the windward plate parts (70) and the leeward plate parts (75).

In the heat exchanger (30) of the first aspect, a space between vertically adjacent ones of the flat tubes (33) is divided into air passages (40) by the windward plate parts (70) of the fins (36). Part of each of the fins (36) located at a leeward side of the notches (45) is a leeward plate part (75) continuous to the windward plate part (70). In the heat exchanger (30), air flowing in the air passages (40) exchanges heat with fluid flowing in the passages (34) in the flat tubes (33).

In each of the windward plate parts (70) of the fins (36) of the first aspect, the flat parts (72, 73) extending along the notches (45) are respectively provided above and below the heat transfer promotion part (71). Thus, in the air passages (40), air more easily flows to regions along the flat parts (72, 73) than to regions where the heat transfer promotion parts (71) on the windward plate parts (70) are provided.

On the other hand, on the leeward plate part (75) of each of the fins (36) of the first aspect, one heat transfer promotion part (76) is provided at the leeward side of each of the notches (45). Each of the heat transfer promotion parts (76) on the leeward plate part (75) overlaps with the flat parts (72, 73)

along the notch (45) located at the windward side of this heat transfer promotion part (76). Thus, air that has flown along the flat parts (72, 73) of the windward plate parts (70) strikes the heat transfer promotion parts (76) on the leeward plate part (75), and this flow of air is disturbed by the heat transfer promotion parts (76) on the leeward plate part (75).

In a second aspect of the present disclosure, in the heat exchanger (30) of the first aspect, each of the heat transfer promotion parts (76) on the leeward plate parts (75) of the fins (36) overlaps with the heat transfer promotion parts (71) of two adjacent ones of the windward plate parts (70) sandwiching an associated one of the notches (45), when viewed from the front edges (38) of the fins (36).

In the second aspect, each of the heat transfer promotion parts (76) on the leeward plate parts (75) of the fins (36) overlaps with the flat parts (72, 73) and the heat transfer promotion parts (71) of two adjacent ones of the windward plate parts (70) sandwiching an associated one of the notches (45), when viewed from the front edges (38) of the fins (36). This configuration ensures that air that has flown along the flat parts (72, 73) of the windward plate parts (70) strikes the heat transfer promotion parts (76) on the leeward plate part (75), and this flow of air is disturbed by the heat transfer promotion parts (76) on the leeward plate part (75).

In a third aspect of the present disclosure, in the heat exchanger (30) of the first or second aspect, on each of the windward plate parts (70) of the fins (36), the bent-out part (50*a*, 50*b*) and a protrusion (81-83) located at a windward side of the bent-out part (50*a*, 50*b*) are provided as the heat transfer promotion parts (71).

In general, an air flow is disturbed more greatly by the bent-out parts (50*a*, 50*b*) bending out from the fins (36) than by the protrusions (81-83) protruding from the fins (36). Thus, in most cases, heat transfer is more greatly promoted by the bent-out parts (50*a*, 50*b*) than by the protrusions (81-83). On the other hand, the difference in temperature between air flowing in the air passages (40) and the fins (36) is the largest at the inlets of the air passages (40), and gradually decreases toward the leeward.

In the heat transfer promotion parts (71) on the windward plate parts (70) in the heat exchanger (30) of the third aspect, the protrusions (81-83) are provided at the windward side of the bent-out parts (50*a*, 50*b*). That is, on the windward plate part (70) of the fins (36) of this aspect, the protrusions (81-83) showing a relatively low degree of heat transfer promotion are provided in a windward region where the temperature difference between the air and the fins (36) is relatively large, and the bent-out parts (50*a*, 50*b*) showing a relatively high degree of heat transfer promotion are provided in a leeward region where the temperature difference between the air and the fins (36) is relatively small. This configuration can reduce the difference between the amount of heat exchanged between the air and windward regions of the windward plate parts (70) and the amount of heat exchanged between the air and leeward regions of the windward plate parts (70).

A fourth aspect of the present disclosure is directed to an air conditioner (10) including a refrigerant circuit (20) including the heat exchanger (30) of any one of the first through third aspects, and the refrigerant circuit (20) circulates refrigerant therein, thereby performing a refrigeration cycle.

In the fourth aspect, the heat exchanger (30) of any one of the first through third aspects is connected to the refrigerant circuit (20). In the heat exchanger (30), refrigerant circulating in the refrigerant circuit (20) flows through the fluid passages (34) of the flat tubes (33), and exchanges heat with air flowing in the air passages (40).

Advantages of the Invention

According to the present disclosure, the heat transfer promotion parts (71, 76) are provided on the windward plate parts (70) and the leeward plate parts (75) of the fins (36). On the leeward plate part (75) of each of the fins (36), the heat transfer promotion part (76) overlaps with the flat parts (72, 73) along an associated one of the notches (45) when viewed from the front edge (38) of the fin (36). Since air that has flown along the flat parts (72, 73) of the windward plate part (70) strikes the heat transfer promotion parts (76) on the leeward plate parts (75), this flow of air is disturbed by the heat transfer promotion parts (76) on the leeward plate parts (75). Accordingly, not only heat transfer between the fins (36) and air flowing along the heat transfer promotion parts (71) on the windward plate parts (70) of the fins (36) but also heat transfer between the fins (36) and air that has flown along the flat parts (72, 73) of the windward plate parts (70) is promoted. As a result, according to this aspect, the heat transfer coefficient of the fins (36) can be increased, thereby enhancing performance of the heat exchanger (30).

In the second aspect, each of the heat transfer promotion parts (76) on the leeward plate parts (75) overlaps with both the flat parts (72, 73) and the heat transfer promotion parts (71) on adjacent two of the windward plate parts (70) sandwiching an associated one of the notches (45), when viewed from the front edges (38) of the fins (36). Thus, a larger amount of air that has flown along the flat parts (72, 73) of the windward plate parts (70) strikes the heat transfer promotion parts (76) on the leeward plate parts (75), thereby increasing the amount of air whose flow is disturbed by the heat transfer promotion parts (76) on the leeward plate parts (75). As a result, according to this aspect, the heat transfer coefficient of the fins (36) can be further increased.

In the third aspect, in the heat transfer promotion parts (71) on the windward plate parts (70) of the fins (36), the protrusions (81-83) are located at windward sides of the bent-out parts (50*a*, 50*b*). This configuration can reduce the difference between the amount of heat exchanged between the air and windward regions of the windward plate parts (70) and the amount of heat exchanged between the air and leeward regions of the windward plate parts (70). As a result, according to this aspect, the amounts of drain water and frost generated on the surfaces of the windward plate parts (70) of the fins (36) can be averaged in the entire windward plate parts (70).

BRIEF DESCRIPTION OF THE DRAWINGS

FIG. 5A is a front view of the fin, and FIG. 5B is a cross-sectional view taken along the line B-B in FIG. 5A.

FIG. 6A is a cross-sectional view taken along the line C-C in FIGS. 5A and 5B, and FIG. 6B is a cross-sectional view taken along the line D-D in FIGS. 5A and 5B.

FIG. 8A is a front view of the fin, and FIG. 8B is a cross-sectional view taken along the line E-E in FIG. 8A.

FIG. 10A is a front view of the fin, and FIG. 10B is a cross-sectional view taken along the line F-F in FIG. 10A.

DESCRIPTION OF EMBODIMENTS

Embodiments of the present disclosure will be described with reference to the drawings.

First Embodiment

A first embodiment of the present disclosure will now be described. A heat exchanger (30) according to the first embodiment constitutes an outdoor heat exchanger (23) of an air conditioner (10), which will be described later.

—Air Conditioner—

Figure 1:
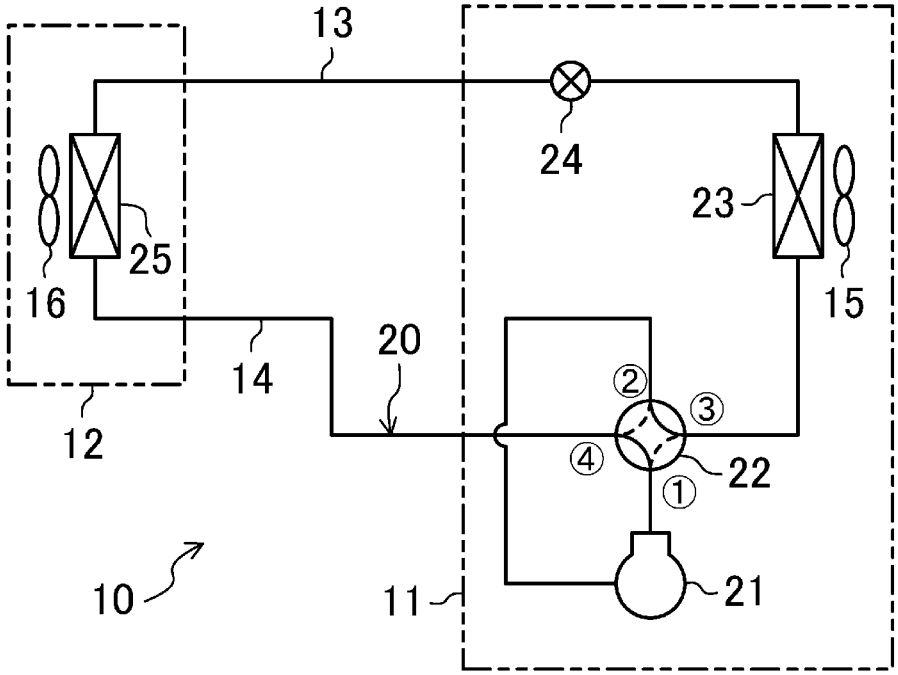
FIG. 1 is a refrigerant circuit diagram schematically illustrating an air conditioner including a heat exchanger according to a first embodiment.

Referring now to FIG. 1, the air conditioner (10) including the heat exchanger (30) of this embodiment will be described.

<Configuration of Air Conditioner>

The air conditioner (10) includes an outdoor unit (11) and an indoor unit (12). The outdoor unit (11) and the indoor unit (12) are connected to each other through a liquid communication pipe (13) and a gas communication pipe (14). In the air conditioner (10), the outdoor unit (11), the indoor unit (12), the liquid communication pipe (13), and the gas communication pipe (14) constitute a refrigerant circuit (20).

The refrigerant circuit (20) includes a compressor (21), a four-way valve (22), an outdoor heat exchanger (23), an expansion valve (24), and an indoor heat exchanger (25). The compressor (21), the four-way valve (22), the outdoor heat exchanger (23), and the expansion valve (24) are housed in the outdoor unit (11). The outdoor unit (11) includes outdoor fans (15) for supplying outdoor air to the outdoor heat exchanger (23). On the other hand, the indoor heat exchanger (25) is housed in the indoor unit (12). The indoor unit (12) includes indoor fans (16) for supplying indoor air to the indoor heat exchanger (25).

The refrigerant circuit (20) is a closed circuit charged with refrigerant. In the refrigerant circuit (20), a discharge side of the compressor (21) is connected to a first port of the four-way valve (22) and a suction side of the compressor (21) is connected to a second port of the four-way valve (22). In the refrigerant circuit (20), the outdoor heat exchanger (23), the expansion valve (24), and the indoor heat exchanger (25) are arranged in this order from a third port to a fourth port of the four-way valve (22).

The compressor (21) is a scroll or rotary hermetic compressor. The four-way valve (22) switches between a first position (indicated by broken lines in FIG. 1) at which the first port communicates with the third port and the second port communicates with the fourth port and a second position (indicated by continuous lines in FIG. 1) at which the first port communicates with the fourth port and the second port communicates with the third port. The expansion valve (24) is a so-called electronic expansion valve.

The outdoor heat exchanger (23) performs heat exchange between outdoor air and refrigerant. The outdoor heat exchanger (23) is constituted by the heat exchanger (30) of this embodiment. On the other hand, the indoor heat exchanger (25) performs heat exchange between indoor air and refrigerant. The indoor heat exchanger (25) is a so-called cross-fin type fin-and-tube heat exchanger including a circular heat transfer tube.

<Cooling Operation>

The air conditioner (10) performs cooling operation. In the cooling operation, the four-way valve (22) is set at the first position. In addition, in the cooling operation, the outdoor fans (15) and the indoor fans (16) operate.

The refrigerant circuit (20) performs a refrigeration cycle. Specifically, refrigerant discharged from the compressor (21) flows into the outdoor heat exchanger (23) through the four-way valve (22), and dissipates heat into the outdoor air to be condensed. Refrigerant that has flown out of the outdoor heat exchanger (23) expands when passing through the expansion valve (24), then flows into the indoor heat exchanger (25), and absorbs heat from the indoor air to evaporate. Refrigerant that has flown out of the indoor heat exchanger (25) passes through the four-way valve (22) and then is sucked into the compressor (21) to be compressed therein. The indoor unit (12) supplies air cooled in the indoor heat exchanger (25) into the room.

<Heating Operation>

The air conditioner (10) performs heating operation. In the heating operation, the four-way valve (22) is set at the second position. In addition, in the heating operation, the outdoor fans (15) and the indoor fans (16) operate.

The refrigerant circuit (20) performs a refrigeration cycle. Specifically, refrigerant discharged from the compressor (21) flows into the indoor heat exchanger (25) through the four-way valve (22), and dissipates heat into the indoor air to be condensed. Refrigerant that has flown out of the indoor heat exchanger (25) expands when passing through the expansion valve (24), then flows into the outdoor heat exchanger (23), and absorbs heat from the outdoor air to evaporate. Refrigerant that has flown out of the outdoor heat exchanger (23) passes through the four-way valve (22) and then is sucked into the compressor (21) to be compressed therein. The indoor unit (12) supplies air heated in the indoor heat exchanger (25) into the room.

<Defrost Operation>

As described above, in the heating operation, the outdoor heat exchanger (23) serves as an evaporator. Under operating conditions where the temperature of the outdoor air is low, the evaporating temperature of refrigerant in the outdoor heat exchanger (23) is lower than 0° C. in some cases. In these cases, moisture in the outdoor air becomes frost and is attached to the outdoor heat exchanger (23). To prevent this, the air conditioner (10) performs defrosting operation every when the time duration of the heating operation reaches a predetermined value (e.g., several ten minutes), for example.

To start defrosting operation, the four-way valve (22) switches from the second position to the first position, and the outdoor fans (15) and the indoor fans (16) stop. In the refrigerant circuit (20) during the defrosting operation, high-temperature refrigerant discharged from the compressor (21) is supplied to the outdoor heat exchanger (23). In the outdoor heat exchanger (23), frost attached to the surface of the outdoor heat exchanger (23) is heated by the refrigerant, and melts. The refrigerant that has dissipated heat in the outdoor heat exchanger (23) passes through the expansion valve (24)

and the indoor heat exchanger (25) in this order, and then is sucked into the compressor (21) to be compressed. After the defrosting operation is finished, heating operation is started again. That is, the four-way valve (22) switches from the first position to the second position, and the outdoor fans (15) and the indoor fans (16) operate again.

—Heat Exchanger of First Embodiment—

The heat exchanger (30) of this embodiment constituting the outdoor heat exchanger (23) of the air conditioner (10) will be described with reference to FIGS. 2-6 as necessary.

<Overall Configuration of Heat Exchanger>

Figure 2:
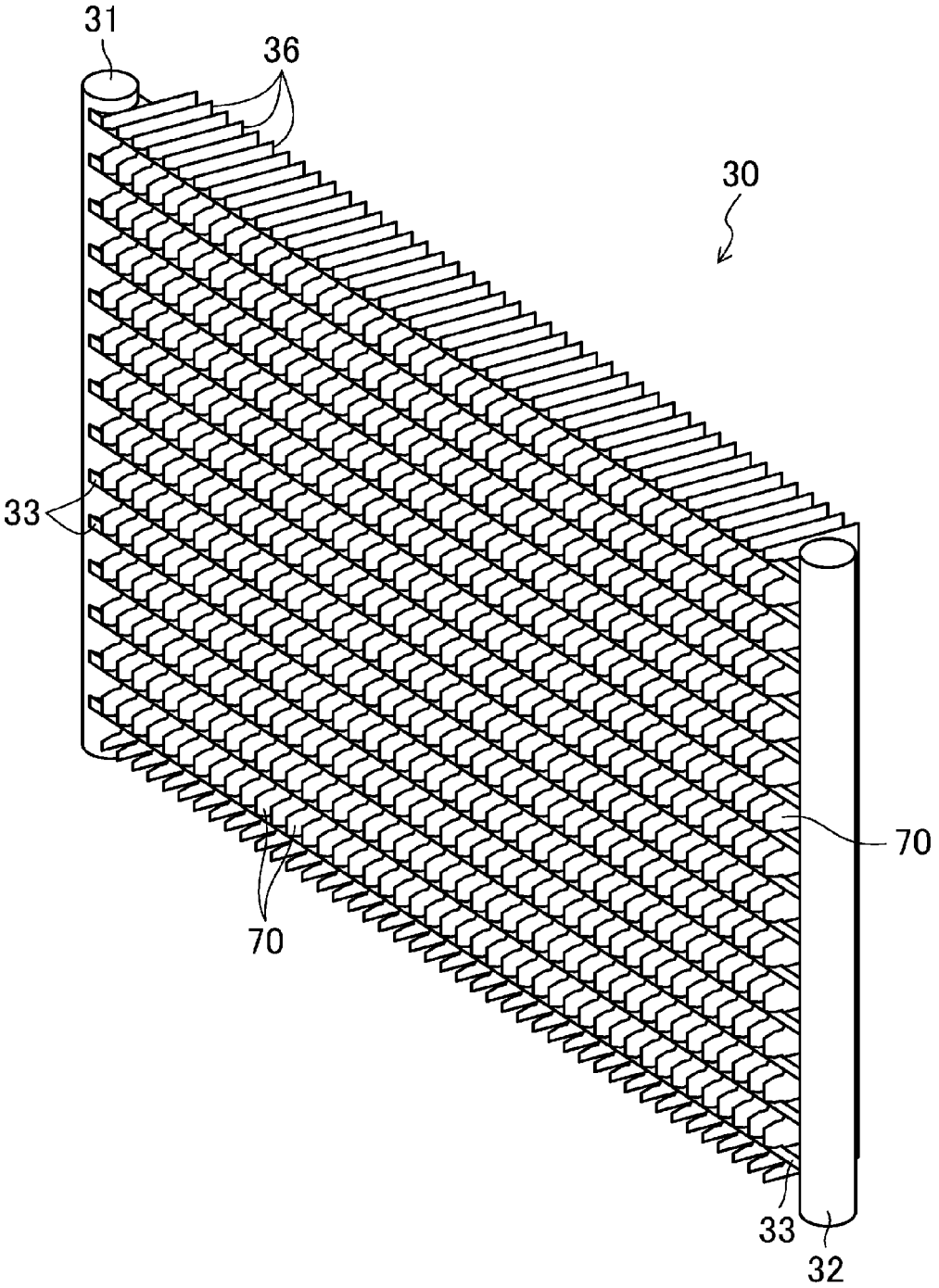
FIG. 2 is a perspective view schematically illustrating the heat exchanger of the first embodiment.
Figure 3:
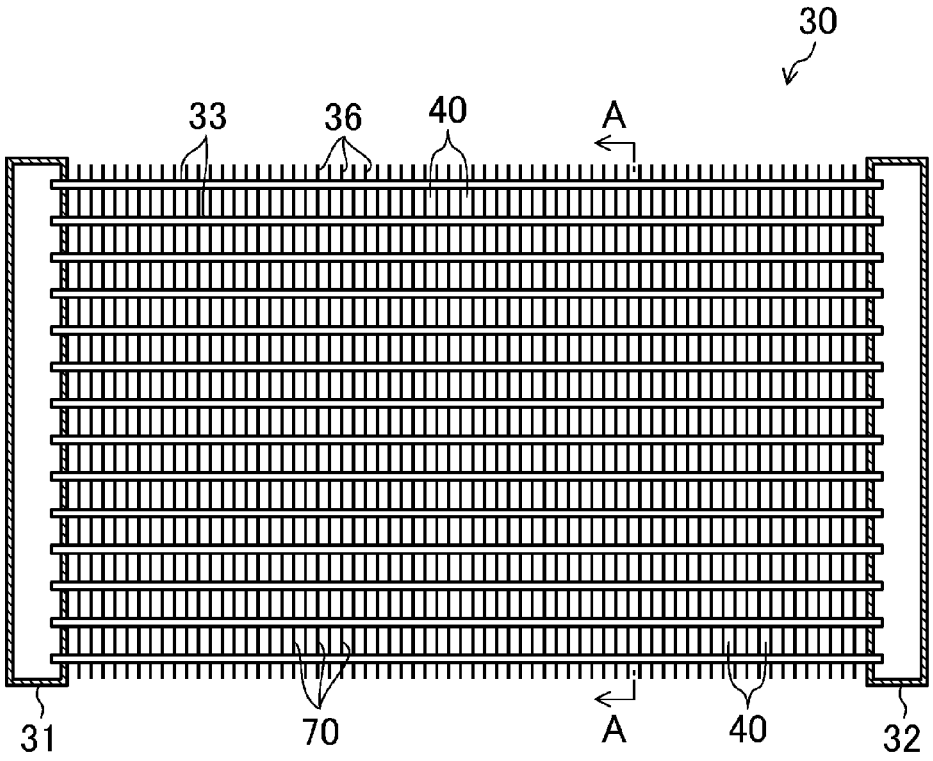
FIG. 3 is a partial cross-sectional view illustrating the heat exchanger of the first embodiment when viewed from the front.

As illustrated in FIGS. 2 and 3, the heat exchanger (30) of this embodiment includes a first header concentrated pipe (31), a second header concentrated pipe (32), a large number of flat tubes (33), and a large number of fins (36). The first header concentrated pipe (31), the second header concentrated pipe (32), the flat tubes (33), and the fins (36) are made of an aluminium alloy, and are joined to one another by brazing.

Each of the first header concentrated pipe (31) and the second header concentrated pipe (32) has a slender hollow cylindrical shape whose both ends are closed. As illustrated in FIG. 3, the first header concentrated pipe (31) stands at the left end of the heat exchanger (30), and the second header concentrated pipe (32) stands at the right end of the heat exchanger (30). That is, the first and second header concentrated pipes (31) and (32) are oriented such that the axes thereof extend in the vertical direction.

Figure 4:
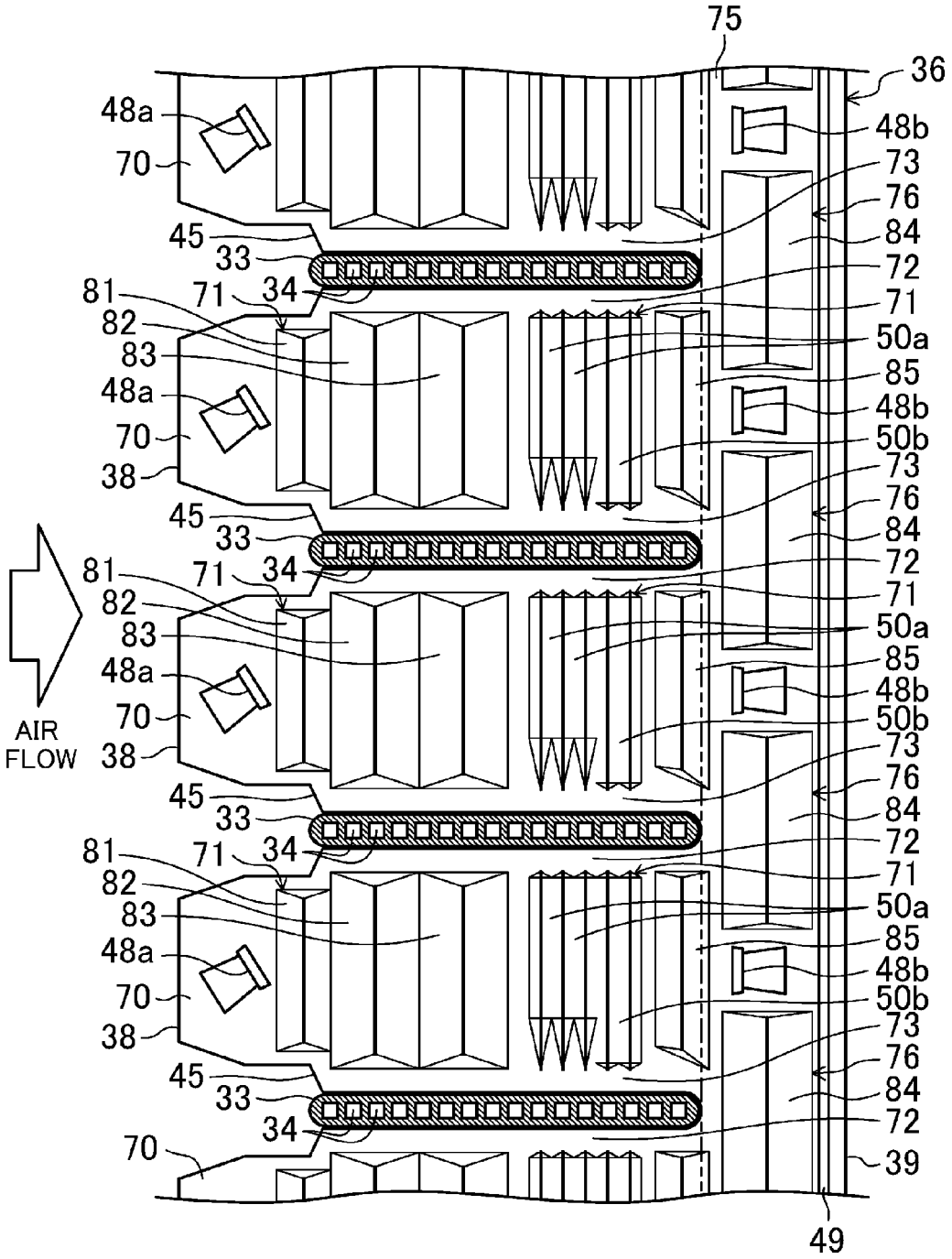
FIG. 4 is a cross-sectional view partially illustrating the heat exchanger taken along the line A-A in FIG. 3.

As also illustrated in FIG. 4, each of the flat tubes (33) is a heat transfer tube that is in the shape of a flat ellipse or a rounded rectangle in cross section. In the heat exchanger (30), the direction in which the flat tubes (33) extend is the transverse direction, and the flat side surfaces of the flat tubes (33) face one another. The flat tubes (33) are spaced from one another in the vertical direction by a predetermined distance. Each of the flat tubes (33) has its one end inserted in the first header concentrated pipe (31) and the other end inserted in the second header concentrated pipe (32).

The fins (36) are plate-like fins and spaced from one another by a predetermined distance in the direction in which the flat tubes (33) extend. That is, the fins (36) are substantially orthogonal to the direction in which the flat tubes (33) extend. Although specifically described later, in each of the fins (36), a portion between vertically adjacent ones of the flat tubes (33) constitutes a windward plate part (70).

As illustrated in FIG. 3, in the heat exchanger (30), a space between vertically adjacent ones of the flat tubes (33) is divided into a plurality of air passages (40) by the windward plate parts (70) of the fin (36). The heat exchanger (30) performs heat exchange between refrigerant flowing in the fluid passages (34) of the flat tubes (33) and air flowing in the air passages (40).

<Fin Configuration>

Figure 5A:
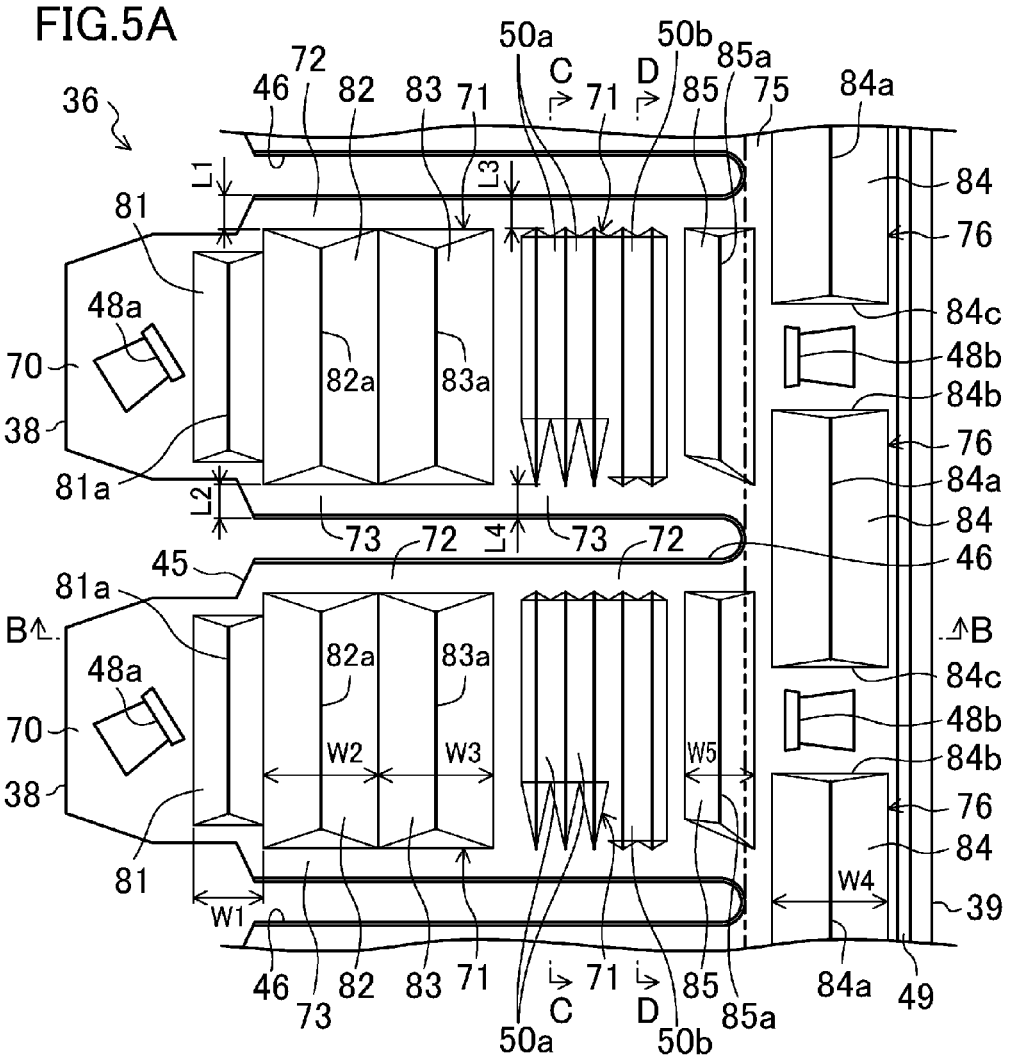
FIGS. 5A and 5B are views illustrating a main portion of a fin of the heat exchanger of the first embodiment.
Figure 5B:
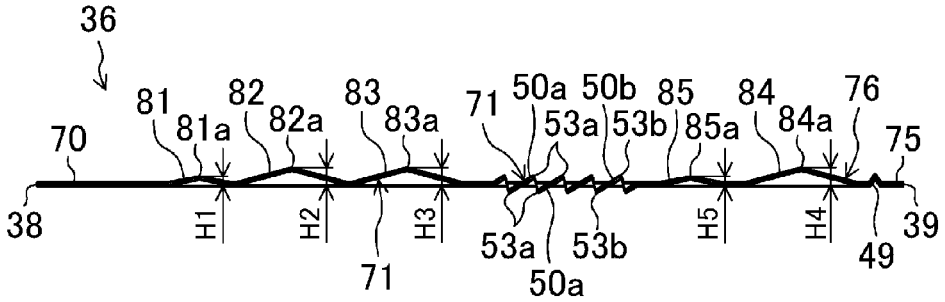

As illustrated in FIGS. 4, 5A, and 5B, each of the fins (36) is an elongate plate-like fin (36) formed by pressing a metal plate. The thickness of each of the fins (36) is approximately 0.1 mm.

Each of the fins (36) has a large number of slender notches (45) extending from a front edge (38) of the fin (36) in the width direction (i.e., in the air passage direction) of the fin (36). In each of the fins (36), the large number of notches (45) are spaced from one another by a predetermined distance in the longitudinal direction (i.e., the vertical direction) of the fin (36). The notches (45) are notches into which the flat tubes (33) are inserted. Leeward portions of the notches (45) constitute pipe insertion portions (46). The vertical width of the pipe insertion portions (46) is substantially equal to the thickness of the flat tubes (33), and the length of the pipe insertion portions (46) is substantially equal to the width of the flat tubes (33).

The flat tubes (33) are inserted into the pipe insertion portions (46) of the fins (36) from the front edges (38) of the fins (36). The flat tubes (33) are joined to the peripheries of the pipe insertion portions (46) by brazing. That is, each of the flat tubes (33) is sandwiched between the periphery of an associated one of the pipe insertion portions (46), which are part of the notches (45).

In each of the fins (36), portions between vertically adjacent ones of the notches (45) are windward plate parts (70), and a portion located at the leeward side of the notches (45) (i.e., a portion of the fin (36) near a rear edge (39)) is a leeward plate part (75). That is, each of the fins (36) includes the vertically arranged windward plate parts (70) and the leeward plate part (75) continuous to all the windward plate parts (70). Each of the windward plate parts (70) is located between vertically adjacent ones of the flat tubes (33), and the leeward plate part (75) is located leeward of the flat tubes (33).

In the windward plates part (70) and the leeward plate part (75) of each of the fins (36), the heat transfer promotion parts (71, 76) and tabs (48*a*, 48*b*) are provided. In the leeward plate part (75), a water-conveyance rib (49) is provided. Each of the fins (36) also includes auxiliary protrusions (85) extending from the windward plate parts (70) to the leeward plate part (75). The heat transfer promotion parts (71, 76) and the auxiliary protrusions (85) will be described later.

The tabs (48*a*, 48*b*) are rectangular flaps formed by bending out the fins (36). The tabs (48*a*, 48*b*) can keep the distance between the fins (36) with the tips thereof being in contact with their adjacent ones of the fins (36). The arrangement of the tabs (48*a*, 48*b*) in the fins (36) will be described later.

The water-conveyance rib (49) is a slender groove vertically extending along a rear edge (39) of the fin (36). The water-conveyance rib (49) extends from the upper end to the lower end of the fin (36).

<Windward Plate Part of Fin>

Each of the windward heat transfer promotion parts (71) provided in the windward plate parts (70) of the fins (36) include louvers (50*a*, 50*b*), which are bent-out parts, and protrusions (81-83). In each of the windward plate parts (70), the protrusions (81-83) are located windward of the louvers (50*a*, 50*b*). The numbers of the protrusions (81-83) and the louvers (50*a*, 50*b*) are merely examples.

Specifically, in each of the windward plate parts (70) of the fins (36), the three protrusions (81-83) are provided in a windward region. The three protrusions (81-83) are arranged side by side in the air passage direction (i.e., the direction from the front edge (38) to the rear edge (39) of the fin (36)). That is, in each of the windward plate part (70), the first protrusion (81), the second protrusion (82), and the third protrusion (83) are arranged in this order from the windward to the leeward.

Each of the protrusions (81-83) has an inverted V shape formed by making the windward plate part (70) protrude toward the air passages (40). Each of the protrusions (81-83) extends in the direction intersecting with the air passage direction in the air passages (40). The three protrusions (81-83) protrude to the same direction. In the fins (36) of this embodiment, the protrusions (81-83) protrude to the right when viewed from the front edge (38) of the fin (36). Ridges (81*a*, 82*a*, 83*a*) of the protrusions (81-83) are substantially in parallel with the front edge (38) of the fin (36). That is, the ridges (81*a*, 82*a*, 83*a*) of the protrusions (81-83) intersect with the air flow direction in the air passages (40).

As illustrated in FIG. 5B, the height H1, in the protrusion direction, of the first protrusion (81) is smaller than the height H2, in the protrusion direction, of the second protrusion (82), and the height H2, in the protrusion direction, of the second protrusion (82) is equal to the height H3, in the protrusion direction, of the third protrusion (83) (i.e., H1<H2=H3). As illustrated in FIG. 5A, the width W1, in the air passage direction, of the first protrusion (81) is smaller than the width W2, in the air passage direction, of the second protrusion (82). The width W2, in the air passage direction, of the second protrusion (82) is equal to the width W3, in the air passage direction, of the third protrusion (83) (i.e., W1<W2=W3).

In each of the windward plate parts (70) of the fins (36), a group of the louvers (50*a*, 50*b*) are provided at the leeward side of the protrusions (81-83). Each of the louvers (50*a*, 50*b*) are obtained by forming slits in the windward plate parts (70) and plastically deforming portions between adjacent ones of the slits. The longitudinal direction of the louvers (50*a*, 50*b*) is substantially in parallel with (i.e., in the vertical direction) of the front edge (38) of the fin (36). That is, the longitudinal direction of the louvers (50*a*, 50*b*) intersects with the air passage direction. The louvers (50*a*, 50*b*) have the same length.

As illustrated in FIG. 5B, the louvers (50*a*, 50*b*) are tilted relative to their peripheral flat portions. Specifically, windward bent-out ends (53*a*, 53*b*) of the louvers (50*a*, 50*b*) protrude to the left when viewed from the front edge (38) of the fin (36). On the other hand, leeward bent-out ends (53*a*, 53*b*) of the louvers (50*a*, 50*b*) protrude to the right when viewed from the front edge (38) of the fin (36).

Figure 6A:
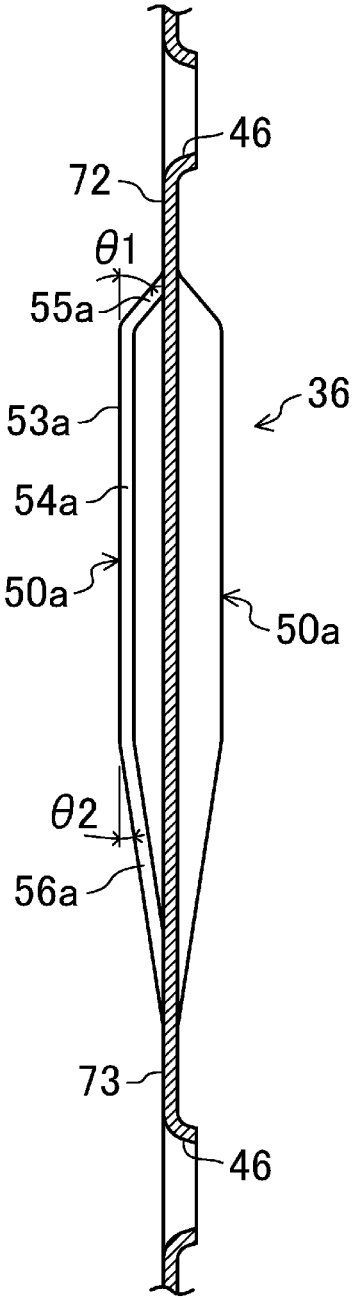
FIGS. 6A and 6B illustrate the fin of the heat exchanger of the first embodiment.
Figure 6B:
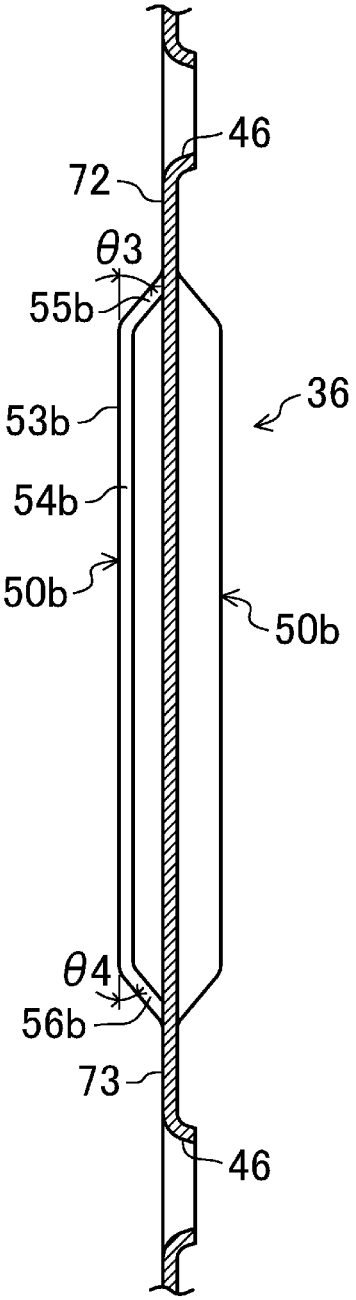

As illustrated in FIGS. 6A and 6B, each of the bent-out ends (53*a*, 53*b*) of the louvers (50*a*, 50*b*) includes a main edge (54*a*, 54*b*), an upper edge (55*a*, 55*b*), and a lower edge (56*a*, 56*b*). The main edge (54*a*, 54*b*) extends substantially in parallel with the front edge (38) of the fin (36). The upper edge (55*a*, 55*b*) extends from the upper end of the main edge (54*a*, 54*b*) to the upper end of the louver (50*a*, 50*b*), and is tilted relative to the main edge (54*a*, 54*b*). The lower edge (56*a*, 56*b*) extends from the lower end of the main edge (54*a*, 54*b*) to the lower end of the louver (50*a*, 50*b*), and is tilted relative to the main edge (54*a*, 54*b*).

As illustrated in FIGS. 5A and 6A, in each of the louvers (50*a*) located in a windward region, a tilt angle θ2 of the lower edge (56*a*) relative to the main edge (54*a*) is smaller than a tilt angle θ1 of the upper edge (55*a*) relative to the main edge (54*a*) (i.e., θ2<θ1). Thus, in each of the louvers (50*a*), the lower edge (56*a*) is longer than the upper edge (55*a*). These windward louvers (50*a*) are asymmetric louvers in each of which the shape of the bent-out end (53*a*) is asymmetric in the vertical direction.

On the other hand, as illustrated in FIGS. 5A and 6B, in each of the louvers (50*b*) located in a leeward region, a tilt angle θ4 of the lower edge (56*b*) relative to the main edge (54*b*) is equal to a tilt angle θ3 of the upper edge (55*b*) relative to the main edge (54*b*) (i.e., θ4=θ3). These louvers (50*b*) are symmetric louvers in each of which the shape of the bent-out end (53*b*) is symmetric in the vertical direction. The tilt angle θ3 of the upper edge (55*b*) in each of the leeward louvers (50*b*) is equal to the tilt angle θ1 of the upper edge (55*a*) in each of the windward louvers (50*a*) (i.e., θ3=θ1).

As illustrated in FIG. 5A, the length L1 from the upper ends of the second protrusion (82) and the third protrusion (83) to the upper end of the windward plate part (70), the length L2 from the lower ends of the second protrusion (82) and the third protrusion (83) to the lower end of the windward plate part (70), the length L3 from the upper ends of the louvers (50*a*, 50*b*) to the upper end of the windward plate part (70), and the length L4 from the lower ends of the louvers (50*a*, 50*b*) to the lower end of the windward plate part (70) are the same. These lengths L1-L4 are preferably as small as possible, and are specifically preferably 1.0 mm or less.

As illustrated in FIGS. 5A, 6A, and 6B, part of each of the windward plate parts (70) of the fins (36) located above the protrusion (82, 83) and the louvers (50*a*, 50*b*) is an upper flat part (72), and part of each of the windward plate parts (70) located below the protrusion (82, 83) and the louvers (50*a*, 50*b*) is a lower flat part (73). The upper flat part (72) and the lower flat part (73) are slender regions along pipe insertion portions (46) of the notches (45). That is, in each of the windward plate parts (70) of the fins (36), the flat parts (72, 73) along the notches (45) are respectively formed above and below the windward heat transfer promotion part (71).

Under constraints of press work, the upper ends of the protrusions (81-83) cannot coincide with the upper ends of the windward plate parts (70), and the lower ends of the protrusions (81-83) cannot coincide with the lower ends of the windward plate parts (70). If the upper ends of the louvers (50*a*, 50*b*) reached the upper ends of the windward plate parts (70), the windward plate parts (70) would be divided. Similarly, if the lower ends of the louvers (50*a*, 50*b*) reached the lower ends of the windward plate parts (70), the windward plate parts (70) would be divided. Thus, the upper ends of the louvers (50*a*, 50*b*) cannot coincide with the upper ends of the windward plate parts (70), and the lower ends of the louvers (50*a*, 50*b*) cannot coincide with the lower ends of the windward plate parts (70). For this reason, in each of the windward plate parts (70) of the fins (36), the flat parts (72, 73) are inevitably respectively formed above and below the windward heat transfer promotion part (71).

As illustrated in FIG. 5A, in each of the windward plate parts (70) of the fins (36), the tab (48*a*) is located windward of the first protrusion (81). The tab (48*a*) is located near the middle, in the vertical direction, of the windward plate part (70). The tab (48*a*) is tilted relative to the front edge (38) of the fin (36).

<Leeward Plate Part of Fin>

The leeward heat transfer promotion parts (76) provided on the leeward plate part (75) of the fin (36) include leeward protrusions (84). In the leeward plate part (75), the leeward protrusions (84) and the tabs (48*b*) are alternately arranged in the vertical direction. Specifically, in the leeward plate part (75), one leeward protrusion (84) is provided at the leeward of each of the notches (45), and one tab (48*b*) is provided between vertically adjacent ones of the leeward protrusions (84).

Each of the leeward protrusions (84) has an inverted V shape formed by making the leeward plate part (75) protrude. The leeward protrusions (84) extend in the direction intersecting with the air passage direction in the air passages (40). In the fins (36) of this embodiment, the leeward protrusions (84) protrude to the right when viewed from the front edges (38) of the fins (36). Ridges (84*a*) of the leeward protrusions (84) are substantially in parallel with the front edges (38) of the fins (36). That is, the ridges (84*a*) of the leeward protrusions (84) intersect with the air flow direction in the air passages (40).

As illustrated in FIG. 5B, the height H4, in the protrusion direction, of the leeward protrusion (84) is equal to the height H3, in the protrusion direction, of the third protrusion (83) (i.e., H4=H3). As illustrated in FIG. 5A, the width W4, in the air passage direction, of the leeward protrusion (84) is equal to the width W3, in the air passage direction, of the third protrusion (83) (i.e., W4=W3).

Each of the leeward protrusions (84) on the leeward plate part (75) overlaps with both the lower flat part (73) and the upper flat part (72) sandwiching the notch (45) adjacent to this leeward protrusion (84), when viewed from the front edge (38) of the fin (36). In addition, each of the leeward protrusions (84) overlaps with the protrusions (81-83) and the louvers (50*a*, 50*b*) constituting the windward heat transfer promotion parts (71) of adjacent two of the windward plate parts (70) sandwiching the notch (45) adjacent to this leeward protrusion (84), when viewed from the front edge (38) of the fin (36).

Specifically, the upper end (84*b*) of each of the leeward protrusions (84) is located above the lower ends of the protrusions (81-83) and the louvers (50*a*, 50*b*) on the windward plate part (70) located above the notch (45) adjacent to this leeward protrusion (84). Thus, part of each of the leeward protrusions (84) near the upper end (84*b*) thereof overlaps with both the lower flat part (73) and the windward heat transfer promotion part (71) on the windward plate part (70) located above the notch (45) adjacent to this leeward protrusion (84), when viewed from the front edge (38) of the fin (36).

On the other hand, the lower end (84*c*) of each of the leeward protrusions (84) is located below the upper ends of the protrusions (81-83) and the louvers (50*a*, 50*b*) on the windward plate part (70) located below the notch (45) adjacent to this leeward protrusion (84). Thus, part of each of the leeward protrusions (84) near the lower end (84*c*) thereof overlaps with both the upper flat part (72) and the windward heat transfer promotion part (71) on the windward plate part (70) located below the notch (45) adjacent to this leeward protrusion (84), when viewed from the front edge (38) of the fin (36).

<Auxiliary Protruding Portion of Fin>

In each of the fins (36), one auxiliary protrusion (85) is provided on a region extending from the windward plate part (70) to the leeward plate part (75).

The auxiliary protrusion (85) has an inverted V shape formed by making the fin (36) protrude. The auxiliary protrusion (85) extends in the direction intersecting with the air passage direction in the air passages (40). In the fins (36) of this embodiment, the auxiliary protrusions (85) protrude to the right when viewed from the front edges (38) of the fins (36). Ridges (85*a*) of the auxiliary protrusions (85) are substantially in parallel with the front edges (38) of the fins (36). That is, the ridges (85*a*) of the auxiliary protrusions (85) intersect with the air flow direction in the air passages (40). In addition, the lower ends of the auxiliary protrusions (85) are tilted downward toward the leeward.

As illustrated in FIG. 5B, the height H5, in the protrusion direction, of the auxiliary protrusion (85) is smaller than the height H3, in the protrusion direction, of the third protrusion (83) (i.e., H5<H3). As illustrated in FIG. 5A, the width W5, in the air passage direction, of the auxiliary protrusion (85) is smaller than the width W3, in the air passage direction, of the third protrusion (83) (i.e., W5<W3).

—Air Flow in Heat Exchanger—

An air flow in the heat exchanger (30) will be described with reference to FIG. 4.

In the heat exchanger (30), the air passages (40) are formed between the windward plate parts (70) that are adjacent one another in the direction in which the flat tubes (33) extend, and air flows through the air passages (40). On the other hand, each of the windward plate parts (70) of the fins (36) includes the windward heat transfer promotion part (71) constituted by the protrusions (81-83) and the louvers (50*a*, 50*b*). In the heat exchanger (30), an air flow in the air passages (40) is disturbed by the protrusions (81-83) and the louvers (50*a*, 50*b*), thereby promoting heat transfer between the fins (36) and the air.

In each of the windward plate parts (70) of the fins (36), the flat parts (72, 73) are provided above and below the protrusions (81-83) and the louvers (50*a*, 50*b*). Thus, in each of the air passages (40), the flow rate of air in a region where the protrusions (81-83) and the louvers (50*a*, 50*b*) are provided (i.e., a middle region, in the vertical direction, of the windward plate part (70)) is relatively low, and the flow rate of air in a region along the upper flat part (72) and the lower flat part (73) (i.e., near the side surfaces of the flat tubes (33)) is relatively high.

On the other hand, on the leeward plate part (75) of the fin (36), the leeward protrusions (84) constituting the leeward heat transfer promotion parts (76) are provided. Each of the leeward protrusions (84) is located at the leeward side of its adjacent notch (45), and overlaps with both the windward heat transfer promotion parts (71) of adjacent two of the windward plate parts (70). Thus, the flow of air that has passed through the region along the upper flat parts (72) and the lower flat parts (73) in the air passages (40) is disturbed when the air flows across the leeward protrusions (84).

In this manner, the flow of air passing through the middle, in the vertical direction, of each of the air passages (40) is disturbed by the protrusions (81-83) and the louvers (50*a*, 50*b*) constituting the windward heat transfer promotion parts (71), and the flow of air passing near the upper and lower ends of each of the air passages (40) is disturbed by the leeward protrusions (84) constituting the leeward heat transfer promotion parts (76). As a result, heat transfer between all the air passing through the air passages (40) and the fins (36) is promoted.

In general, an air flow is disturbed more greatly by the louvers (50*a*, 50*b*) bending out from the fins (36) than by the protrusions (81-83) protruding from the fins (36). Thus, in most cases, heat transfer is more greatly promoted by the louvers (50*a*, 50*b*) than by the protrusions (81-83). On the other hand, the difference in temperature between air flowing in the air passages (40) and the fins (36) is the largest at the inlets of the air passages (40), and gradually decreases toward the leeward.

In each of the intermediate portions (71) on the windward plate parts (70) of the fins (36) of this embodiment, the protrusions (81-83) are located at the windward of the louvers (50*a*, 50*b*). That is, in each of the windward plate parts (70) of the fins (36) of this embodiment, the protrusions (81-83) showing a relatively low degree of heat transfer promotion are provided in a windward region where the temperature difference between the air and the fins (36) is relatively large, and the louvers (50*a*, 50*b*) showing a relatively high degree of heat transfer promotion are provided in a leeward region where the temperature difference between the air and the fins (36) is relatively small. This configuration can reduce the difference between the amount of heat exchanged between the air and windward regions of the windward plate parts (70) and the amount of heat exchanged between the air and leeward regions of the windward plate parts (70).

Advantages of First Embodiment

In the heat exchanger (30) of this embodiment, the heat transfer promotion parts (71, 76) are provided on the windward plate parts (70) and the leeward plate parts (75) of the fins (36). Each of the leeward protrusions (84) provided on the leeward plate parts (75) of the fins (36) overlaps with the protrusions (81-83) and the louvers (50*a*, 50*b*) of adjacent two of the windward plate parts (70) sandwiching the notch (45) adjacent to this leeward protrusion (84), when viewed from the front edge of the fin (36). Air that has flown along the flat parts (72, 73) adjacent to the notches (45) in the windward plate part (70) strikes the leeward protrusions (84) on the leeward plate parts (75), and the air flow thereof is disturbed by the leeward protrusions (84).

Thus, not only heat transfer between the fins (36) and air flowing along the windward heat transfer promotion parts (71) on the windward plate parts (70) of the fins (36) but also heat transfer between the fins (36) and air that has flown along the flat parts (72, 73) of the windward plate parts (70) is promoted. As a result, in this embodiment, the heat transfer coefficient of the fins (36) can be increased, thereby enhancing performance of the heat exchanger (30).

On the windward plate parts (70) of the fins (36) of this embodiment, the protrusions (81-83) are located at the windward side of the louvers (50*a*, 50*b*). This configuration can reduce the difference between the amount of heat exchanged between the air and windward regions of the windward plate parts (70) and the amount of heat exchanged between the air and leeward regions of the windward plate parts (70). That is, in the heat exchanger (30) of this embodiment, the amount of heat exchange between the fins (36) and air in each portion of the windward plate parts (70) of the fins (36) is averaged.

Accordingly, in the heat exchanger (30) of this embodiment when used as the outdoor heat exchanger (23) of the air conditioner (10), the amounts of frost attached to portions of the windward plate parts (70) of the fins (36) during heating operation of the air conditioner (10) can be averaged. Thus, the use of the heat exchanger (30) of this embodiment as the outdoor heat exchanger (23) of the air conditioner (10) can reduce the frequency of defrosting operation to prolong time duration of heating operation. As a result, substantial heating capacity of the air conditioner (10) can be increased.

Second Embodiment

A second embodiment of the present disclosure will be described. A heat exchanger (30) according to the second embodiment is obtained by changing the configuration of the leeward heat transfer promotion parts (76) of the heat exchanger (30) of the first embodiment. Now, part of the configuration of the heat exchanger (30) of the second embodiment different from that of the heat exchanger (30) of the first embodiment will be described.

Figure 7:
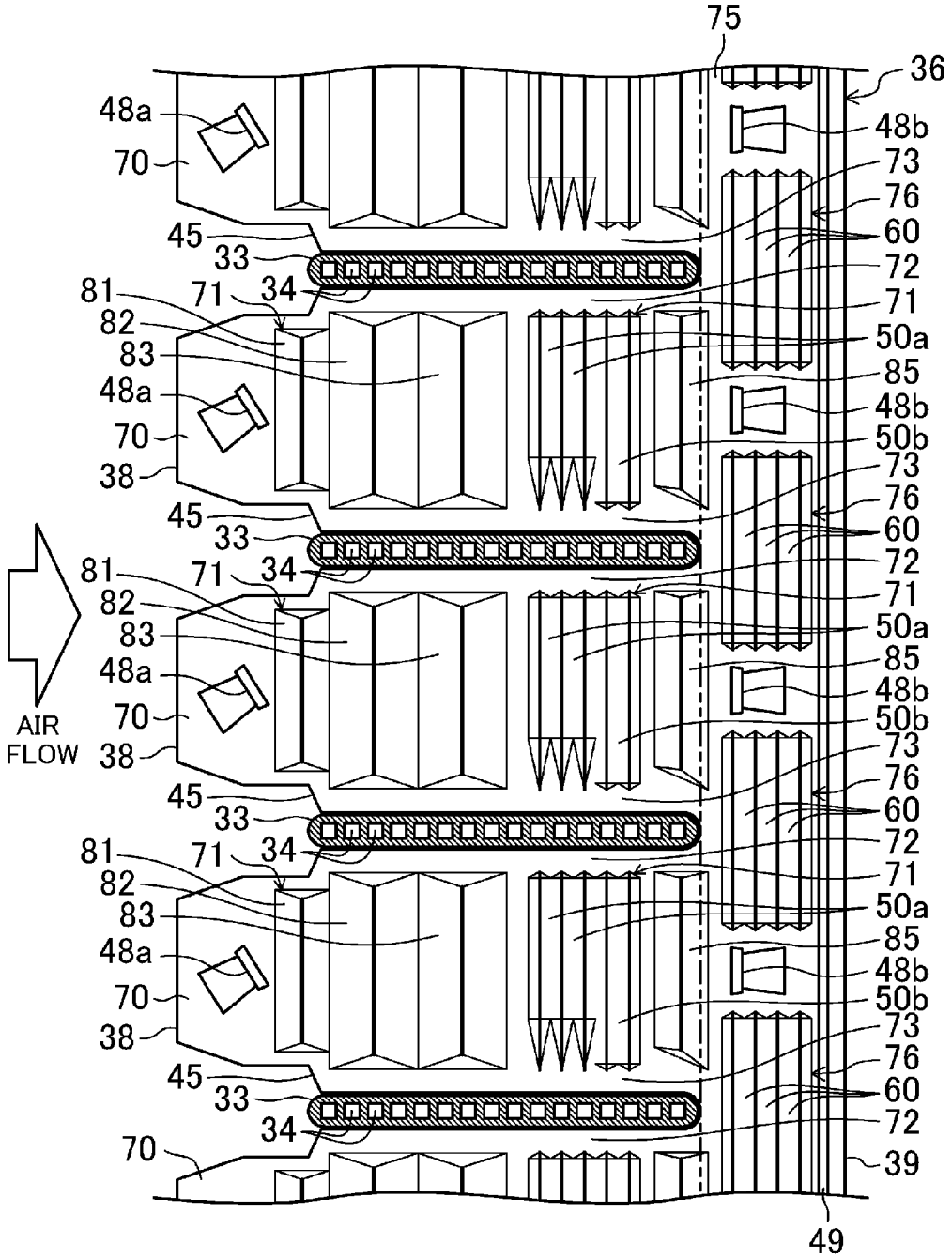
FIG. 7 is a cross-sectional view illustrating a heat exchanger according to a second embodiment and corresponds to FIG. 3.
Figure 8A:
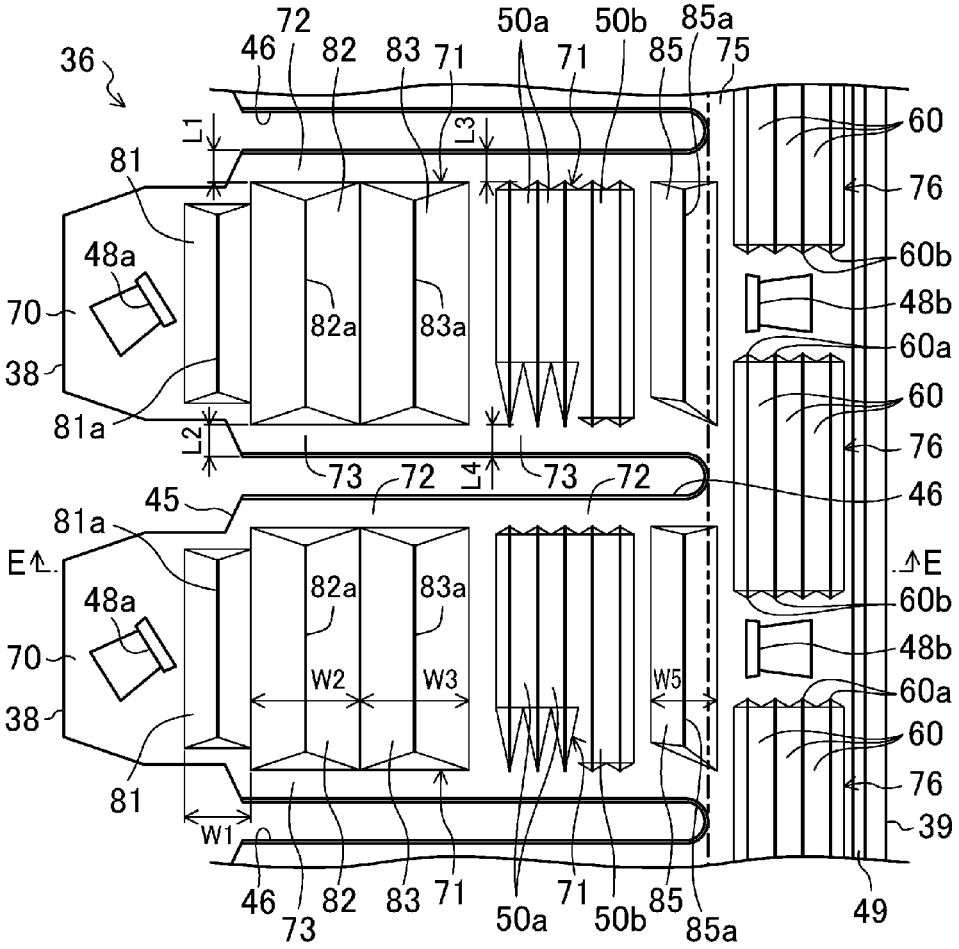
FIGS. 8A and 8B illustrate a main portion of a fin of the heat exchanger of the second embodiment.
Figure 8B:
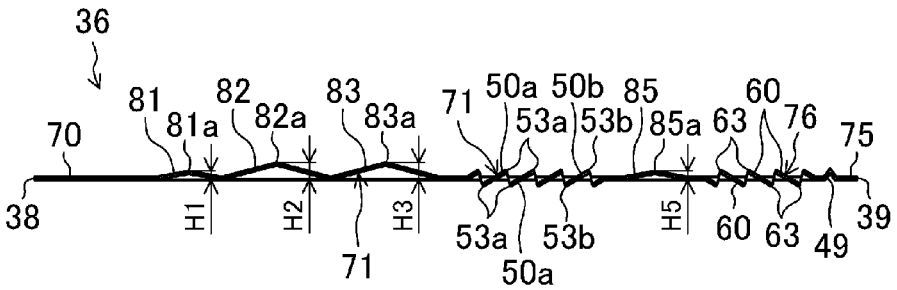

As illustrated in FIGS. 7, 8A, and 8B, on a leeward plate part (75) of each of fins (36) of the heat exchanger (30) of this embodiment, leeward heat transfer promotion parts (76) constituted by leeward louvers (60), which are bent-out parts, are provided. That is, on the leeward plate part (75) of the fin (36) of this embodiment, a group of leeward louvers (60) are provided instead of the leeward protrusions (84) of the first embodiment.

Specifically, the leeward heat transfer promotion parts (76) provided on the leeward plate part (75) of this embodiment include a plurality of leeward louvers (60) arranged side by side in the front-to-rear direction.

As illustrated in FIG. 8B, the leeward louvers (60) are tilted relative to their peripheral flat portions. Windward bent-out ends (63) of the leeward louvers (60) protrude to the right when viewed from a front edge (38) of the fin (36). On the other hand, leeward bent-out ends (63) of the leeward louvers (60) protrude to the left when viewed from the front edge (38) of the fin (36).

FIG. 8A, the leeward louvers (60) have the same length in the vertical direction. In the same manner as louvers (50*b*) in a leeward region of windward plate parts (70), the leeward louvers (60) are symmetric louvers in each of which the shape of the bent-out end (63) is symmetric in the vertical direction.

Each of the leeward louvers (60) on the leeward plate part (75) overlaps with both a lower flat part (73) and an upper flat part (72) that are adjacent to each other and sandwich a notch (45) adjacent to this leeward louver (60), when viewed from the front edge (38) of the fin (36). In addition, each of the leeward louvers (60) overlaps with protrusions (81-83) and louvers (50*a*, 50*b*) constituting windward heat transfer promotion parts (71) on adjacent two of the windward plate parts (70) sandwiching the notch (45) adjacent to this leeward louver (60), when viewed from the front edge (38) of the fin (36).

Specifically, an upper end (60*a*) of each of the leeward louvers (60) is located above the lower ends of the protrusions (81-83) and the louvers (50*a*, 50*b*) on the windward plate part (70) located above the notch (45) adjacent to this leeward louver (60). Thus, part of each of the leeward louvers (60) near the upper end (60*a*) thereof overlaps with both the lower flat part (73) and the windward heat transfer promotion part (71) on the windward plate part (70) located above the notch (45) adjacent to this leeward louver (60), when viewed from the front edge (38) of the fin (36).

On the other hand, a lower end (60*b*) of each of the leeward louvers (60) is located below the upper ends of the protrusions (81-83) and the louvers (50*a*, 50*b*) on the windward plate part (70) located below the notch (45) adjacent to this leeward louver (60). Thus, part of each of the leeward louvers (60) near the lower end (60*b*) thereof overlaps with both the upper flat part (72) and the windward heat transfer promotion part (71) on the windward plate part (70) located below the notch (45) adjacent to this leeward louver (60), when viewed from the front edge (38) of the fin (36).

In the heat exchanger (30) of this embodiment, the flow of air that has passed along the upper flat part (72) and the lower flat part (73) in air passages (40) is disturbed when striking the leeward louvers (60). Thus, in the heat exchanger (30) of this embodiment, the flow of air passing through the middle, in the vertical direction, of each of the air passages (40) is disturbed by the protrusions (81-83) and the louvers (50*a*, 50*b*) constituting the windward heat transfer promotion parts (71), and the flow of air passing near the upper and lower ends of each of the air passages (40) is disturbed by the leeward louvers (60) constituting the leeward heat transfer promotion parts (76). As a result, heat transfer between all the air passing through the air passages (40) and the fins (36) is promoted.

Third Embodiment

A third embodiment of the present disclosure will be described. A heat exchanger (30) according to the third embodiment is obtained by changing the configuration of the fins (36) in the heat exchanger (30) of the first embodiment. Now, part of the configuration of fins (36) of the heat exchanger (30) of this embodiment different from that of the heat exchanger (30) of the first embodiment will be described.

Figure 9:
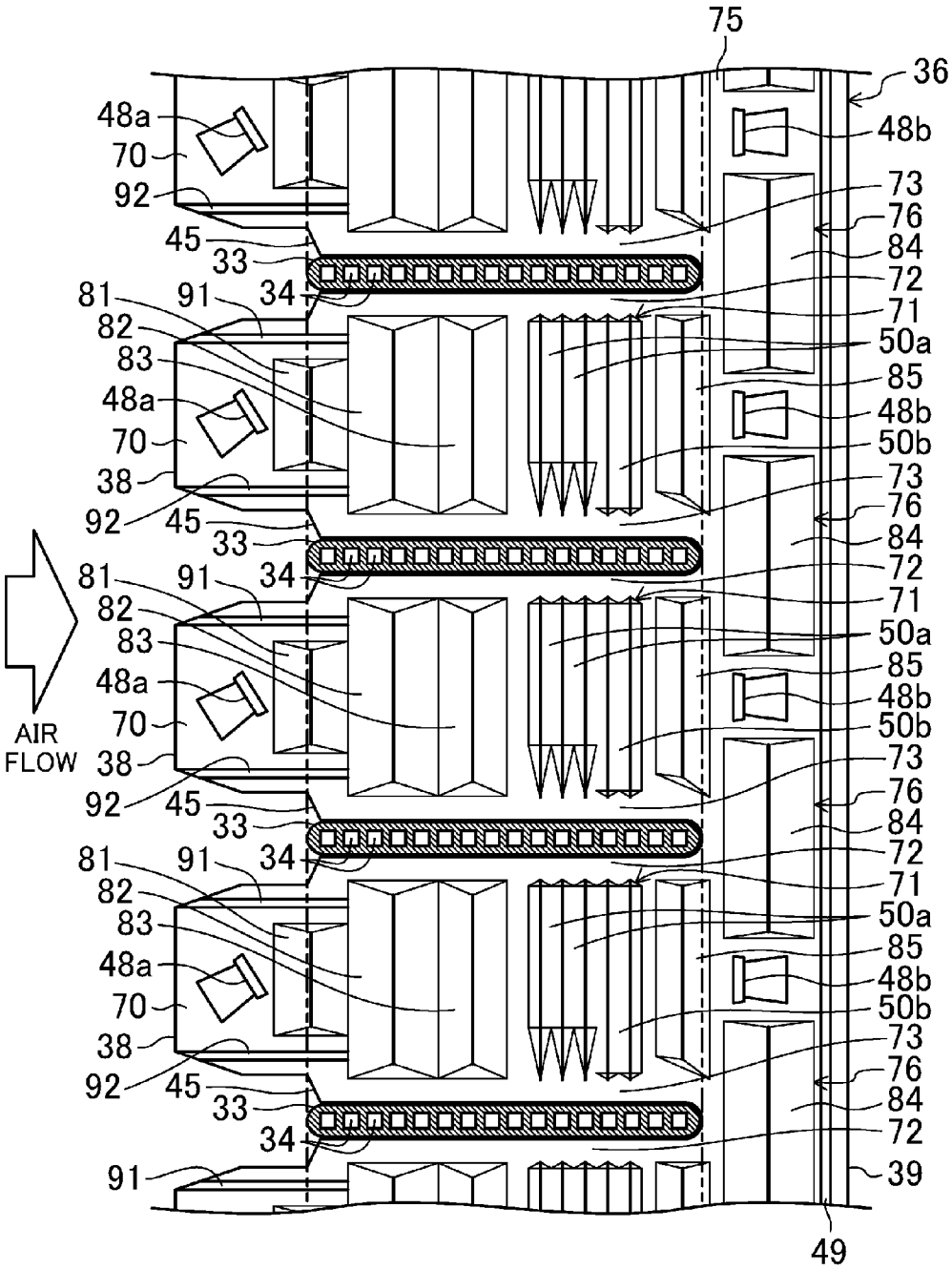
FIG. 9 is a cross-sectional view illustrating a heat exchanger according to a third embodiment and corresponds to FIG. 3.
Figure 10A:
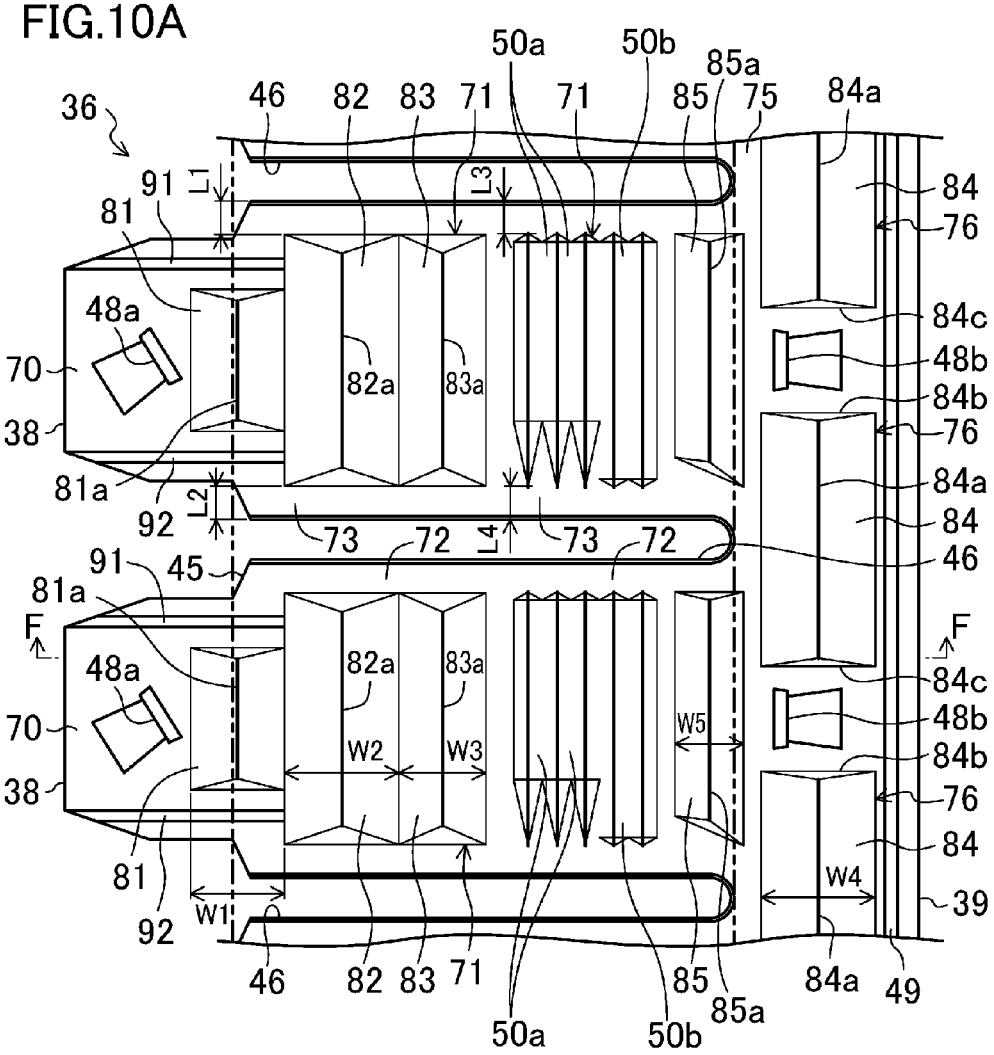
FIGS. 10A and 10B illustrate a main portion of a fin of the heat exchanger of the third embodiment.
Figure 10B:
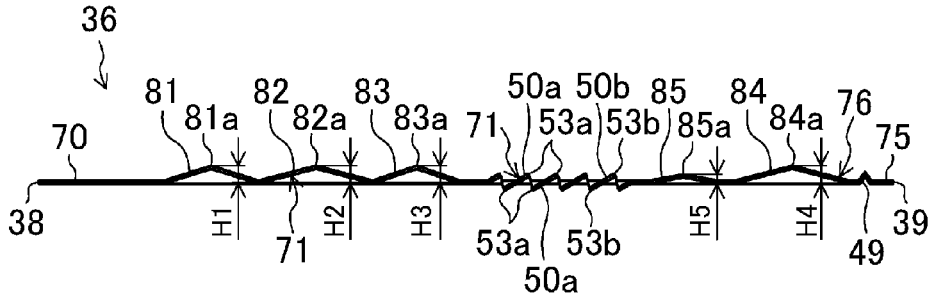

As illustrated in FIGS. 9, 10A, and 10B, an upper horizontal rib (91) and a lower horizontal rib (92) are additionally provided on each windward plate part (70) of fins (36) of the heat exchanger (30) of this embodiment. The upper horizontal rib (91) is located above a first protrusion (81), and the lower horizontal rib (92) is located below the first protrusion (81). The horizontal ribs (91, 92) have straight slender ridge shapes extending from a front edge (38) of the fin (36) to a second protrusion (82). In the same manner as protrusions (81, 82, 83, 84), the horizontal ribs (91, 92) are formed by making the windward plate part (70) protrude toward air passages (40). The horizontal ribs (91, 92) protrude in the same direction as the direction in which the protrusions (81, 82, 83, 84) protrude.

In the fins (36) of this embodiment, the first protrusion (81) is shorter than the first protrusion (81) of the first embodiment. As illustrated in FIG. 10B, in the fins (36) of this embodiment, the first protrusion (81), the second protrusion (82), the third protrusion (83), and the leeward protrusion (84) have the same height in the protrusion direction (i.e., H1=H2=H3=H4), and the height, in the protrusion direction, of an auxiliary protrusion (85) is smaller than that of the leeward protrusion (84) (i.e., H5<H4). As illustrated in FIG. 10A, in the fins (36) of this embodiment, the second protrusion (82) and the leeward protrusion (84) have the same width (i.e., W2=W4), and the widths of the second protrusion (82), the first protrusion (81), the third protrusion (83), and the auxiliary protrusions (85) decreases in this order (i.e., W2>W1>W3>W5).

As described above, the upper horizontal rib (91) and the lower horizontal rib (92) are provided in a region extending from the front edge (38) of the fin (36) to the second protrusion (82). Thus, in each of the fins (36) of this embodiment, portions of the windward plate parts (70) projecting to the windward from flat tubes (33) have higher rigidity than those in the fins (36) of the first embodiment, thereby reducing deformation of these portions.

Other Embodiments

—First Variation—

In the heat exchangers (30) of the above embodiments, the windward heat transfer promotion parts (71) may be constituted by only protrusions or louvers. In the heat exchangers (30) of the above embodiments, the leeward heat transfer promotion parts (76) on the leeward plate parts (75) of the fins (36) may be constituted by both protrusions and louvers.

—Second Variation—

In the heat exchangers (30) of the above embodiments, each of the leeward heat transfer promotion parts (76) on the leeward plate parts (75) of the fins (36) may overlap with only the flat parts (72, 73) adjacent to each other and sandwiching the notch (45) adjacent to this leeward heat transfer promotion part (76).

For example, in the heat exchangers (30) of the above embodiments, each of the leeward heat transfer promotion parts (76) on the leeward plate part (75) may overlap with only the lower flat part (73) and the upper flat part (72) adjacent to each other and sandwiching the notch (45) adjacent to this leeward heat transfer promotion part (76), and may overlap with none of the windward heat transfer promotion parts (71) adjacent to each other and sandwiching the notch (45) adjacent to this leeward heat transfer promotion part (76). In this case, the upper end (60*a*, 84*b*) of each of the leeward heat transfer promotion parts (76) is located between the notch (45) adjacent to this leeward heat transfer promotion part (76) and the lower ends of the protrusions (81-83) and the louvers (50*a*, 50*b*) of the windward plate part (70) located above this notch (45). On the other hand, the lower end (60*b*, 84*c*) of each of the leeward heat transfer promotion parts (76) is located between the notch (45) adjacent to this leeward heat transfer promotion part (76) and the upper ends of the protrusions (81-83) and the louvers (50*a*, 50*b*) of the windward plate part (70) located below this notch (45).

In the heat exchangers (30) of the above embodiments, each of the heat transfer promotion parts (76) on the leeward plate part (75) may overlap with only the lower flat part (73) located above the notch (45) adjacent to this leeward heat transfer promotion part (76). In this case, the upper end (60*a*, 84*b*) of each of the leeward heat transfer promotion parts (76) is located above the notch (45) adjacent to this leeward heat transfer promotion part (76). On the other hand, the lower end (60*b*, 84*c*) of each of the leeward heat transfer promotion parts (76) overlaps with the notch (45) adjacent to this leeward heat transfer promotion part (76), when viewed from the front edge (38) of the fin (36).

In the heat exchangers (30) of the above embodiments, each of the leeward heat transfer promotion parts (76) on the leeward plate part (75) may overlap with only the upper flat part (72) located below the notch (45) adjacent to this leeward heat transfer promotion parts (76). In this case, the upper end (60*a*, 84*b*) of each of the leeward heat transfer promotion parts (76) overlaps with the notch (45) adjacent to this leeward heat transfer promotion part (76), when viewed from the front edge (38) of the fin (36). On the other hand, the lower end (60*b*, 84*c*) of each of the leeward heat transfer promotion parts (76) is located below the notch (45) adjacent to this leeward heat transfer promotion part (76).

The foregoing embodiments are merely preferred examples in nature, and are not intended to limit the scope, applications, and use of the invention.

INDUSTRIAL APPLICABILITY

As described above, the present disclosure is useful for a heat exchanger including flat tubes and fins and used for allowing fluid flowing in the flat tubes to exchange heat with the air.

DESCRIPTION OF REFERENCE CHARACTERS

10 air conditioner
20 refrigerant circuit
30 heat exchanger
33 flat tube
34 fluid passage (passage)
36 fin
38 front edge
40 air passage
45 notch
50*a* louver (bent-out part)
50*b* louver (bent-out part)
60 louver (bent-out part)
70 windward plate part
71 windward heat transfer promotion part
75 leeward plate part
76 leeward heat transfer promotion part
81 first protrusion
82 second protrusion
83 third protrusion
84 leeward protrusion

The invention claimed is:

1. A heat exchanger, comprising:

vertically arranged flat tubes each including a fluid passage therein; and fins having plate shapes, spaced from one another by a predetermined distance in a direction in which the flat tubes extend and each dividing a space between adjacent ones of the flat tubes into a plurality of air passages through which air flows, wherein the fins each have notches into which the flat tubes are inserted from front edges of the fins and which are spaced from one another by a predetermined distance in a longitudinal direction of the fins, parts of the fins between vertically adjacent ones of the notches are windward, plate parts, parts of the fins at leeward sides of the notches are leeward plate parts, windward heat transfer promotion parts each including at least one of a bent-out part extending in a direction intersecting with an air passage direction or a protrusion extending, in the direction intersecting, with the air passage direction are provided on the windward plate parts, parts of the windward plate parts of the fins extending along the notches located above and below the heat transfer promotion part find serve as flat parts, a plurality of leeward heat transfer promotion parts that are each a protrusion extending in the direction intersecting with the air passage direction are provided on the leeward plate parts, on the leeward plate parts of the fins, each of the leeward heat transfer promotion parts is located at a leeward side of an associated one of the notches, the leeward heat transfer promotion parts are arranged at predetermined intervals in said longitudinal direction of the fins, and each of the leeward heat transfer promotion parts overlaps with the flat part extending along the associated one of the notches, when viewed from the front edges of the fins.

2. The heat exchanger of claim 1, wherein each of the heat leeward transfer promotion parts overlaps with the leeward heat transfer promotion parts of two adjacent ones of the windward plate parts sandwiching an associated one of the notches, when viewed from the front edges of the fins.

3. The heat exchanger of claim 1, wherein on each of the windward plate parts of the fins, a bent-out part and a protrusion located at a windward side of the bent-out part are provided as the leeward heat transfer promotion parts.

4. An air conditioner, comprising:

a refrigerant circuit including the heat exchanger of claim 1, wherein the refrigerant circuit circulates refrigerant therein, thereby performing a refrigeration cycle.

5. The heat exchanger of claim 2, wherein on each of the windward plate, parts of the fins, a bent-out part and a protrusion located at a windward side of the bent-out part are provided as the leeward heat transfer promotion parts.

* * * * *